US005454237A

United States Patent [19]

Pellerin

[11] Patent Number: 5,454,237

[45] Date of Patent: Oct. 3, 1995

[54] CONTINUOUS BATCH TYPE WASHING MACHINE

[75] Inventor: James W. Pellerin, Metairie, La.

[73] Assignee: Pellerin Milnor Corporation, Kenner, La.

[21] Appl. No.: 227,265

[22] Filed: Apr. 13, 1994

[51] Int. Cl.[6] ..... D06F 31/00

[52] U.S. Cl. ..... 68/27; 68/143

[58] Field of Search ..... 68/27, 58, 143, 68/145, 158; 134/69

[56] References Cited

U.S. PATENT DOCUMENTS

| | | | |
|---|---|---|---|
| 2,056,803 | 10/1936 | Failing | 68/158 X |
| 3,693,639 | 9/1972 | Corbett | 134/69 |
| 4,109,493 | 8/1978 | Hugenbruch | 68/27 |
| 4,156,358 | 5/1979 | Harrsch | 68/27 |
| 4,236,393 | 12/1980 | Katzfey | 68/27 |
| 5,211,039 | 5/1993 | Pellerin | 68/27 |

*Primary Examiner*—Philip R. Coe

*Attorney, Agent, or Firm*—Vaden, Eickenroht, Thompson & Feather

[57] ABSTRACT

There are disclosed two embodiments of a top transfer type continuous batch washing machine comprising an intermediate outer housing and an additional outer housing at each end thereof, with each outer housing having one or more bath sections, and a continuous elongate inner housing made up of cylindrically shaped drums having their inlets and outlets connected to one another. Rollers are mounted on the outside of the outer housings in position to support tubular members which extend between adjacent sections of the inner housing to suspend the lower portion of each drum of an intermediate section in a bath section of the intermediate outer housing and the lower portion of each drum of each outer section in a bath section of an additional outer housing. Chains are also mounted on the outside of the outer housings to rotate the tubular members and thus the inner housing as a whole, and the module or modules of each drum has a scoop arranged to oscillate or rotate in one directional sense to permit circulation of liquid through the goods and rotate in the opposite directional sense to transfer the goods through the outlet into the inlet of an adjacent drum or module.

14 Claims, 4 Drawing Sheets

CONTINUOUS BATCH TYPE WASHING MACHINE

This invention relates generally to continuous batch type washing machines. More particularly, it relates to improvements in continuous batch type washing machines of the so-called top transfer type.

In a machine of this type shown in U.S. Pat. No. 4,236,393, assigned to the assignee of the present application, cylindrically shaped drums are each supported in end-to-end relation for rotation within individual outer housings or shells. The outer wall of each drum is perforated to immerse a batch of goods therein within bath liquid contained in the lower portion of the outer housing. Each drum has a central inlet and outlet in its opposite end walls so that successive batches of goods may be loaded into the machine through an inlet to the outer drum at one end of the machine, transferred from one drum to the next as a new batch is received therein, following each wash cycle, and ultimately unloaded from the machine through an outlet in the outer drum at the other end of the machine.

More particularly, each drum has a scoop which extends between its end walls and is so constructed and arranged relative to the inlet and outlet of the drum as to permit the circulation of liquid within the bath section through the goods, while preventing transfer of the goods out of the drum through its outlet, in response to rotation of the inner housing in one directional sense or limited rotation of the inner housing, but transfer goods out of the drum through the outlet, in response to rotation of the inner housing in the opposite directional sense.

As shown in U.S. Pat. No. 4,236,393, each drum comprises a single module having a single scoop whose outlet end is connected to the inlet end of the single scoop of an adjacent downstream drum. However, some machines of this general type have so-called "tandem" drums including two or more modules having their scoops connected in end-to-end relation, whereby all modules of that drum share liquid in the same bath section.

U.S. Pat. No. 5,211,039, also assigned to the assignee of the present application, discloses a machine of this general type which is, in turn, an improvement upon that of U.S. Pat. No. 4,236,393 in that, among other things, it is of simpler construction and occupies less space. Thus, as shown in such patent, the individual outer housings are replaced by an elongate outer housing or shell having an inlet and outlet in its opposite ends and lateral walls which divide at least its bottom portion into individual bath sections, and the individual drums are replaced by an elongate continuous inner housing made up of a plurality of drums with the outlet of each welded or otherwise connected to the inlet of an adjacent drum. More particularly, only the outer ends of the end drums of the inner housing which are external to the outer housing are rotatably supported from a base surface so as to suspend the lower portion of each drum within an individual bath section as it is rotated by a chain drive disposed about each such outer end—i.e., the intermediate drums are unsupported so that it is not necessary to immerse support rollers or drive systems for them in liquid within the outer housing. As in the case of the machine of U.S. Pat. No. 4,236,393, each drum is shown to be of the single module type, although one or more may instead be of the tandem type.

It was found, however, that with larger machines of the type shown in U.S. Pat. No. 5,211,039, requiring more drums, or at least more drum modules, the drums in the middle of the inner housing often experienced excessive bending loads at the connections between them, and it is the object of this invention to provide a machine of this type which may have greater numbers of drums without this problem.

This and other objects are accomplished, in accordance with the present invention, by such a machine which comprises an intermediate outer housing and a pair of additional outer housings on each end of the intermediate outer housing, with the ends of the adjacent outer housings having oppositely facing inlets and outlets, and the bottom portion of each having one or more individual bath sections, and a continuous elongate inner housing comprising a plurality of generally cylindrically shaped drums each having a perforated outer wall, an inlet in one end wall through which goods may enter the drum and an outlet in its other end wall connected to the inlet of an adjacent drum. More particularly, the elongate inner housing is rotatably supported and driven externally of the outer housings at only the connections of the drums of intermediate and additional sections thereof so as to suspend the lower portion of each drum of the intermediate section in a bath section of the intermediate outer housing and the lower portion of each drum of each additional section in a bath section of an additional outer housing. Thus, as in the case of the machine of U.S. Pat. No. 5,211,039, none of the support and drive systems need be immersed in liquid.

However, as compared with the prior machine, the additional sections of the elongate inner housing provide cantilever loading which tend to balance the weight of the intermediate section which might otherwise experience excessive bending loads. Thus, for example, if the machine of this invention were to be cut in half, intermediate its length, the separate halves would tend to be balanced if the weight of the drums on each side of the center support was the same. As a result, the machine may include a greater number of drums than the above described prior art machine.

As shown, the ends of adjacent drums of adjacent sections of the inner housing are connected by tubular members, which are in turn supported and driven by rollers and chains carried outside the outer housing. Also, the machine includes means such as pedestals supporting each of the outer housing sections from a base surface, preferably, with each such section supported adjacent its opposite ends.

In one embodiment of the invention, each drum consists of a single module, as in U.S. Pat. Nos. 4,236,393 and 5,211,039, wherein the outlet of each is connected to the inlet of the single module of the adjacent drum. In another embodiment of the invention, each drum is of the tandem type having at least two end-to-end modules, with the outlet of each connected to the inlet of another module of the same drum or to the module of an adjacent downstream drum.

In the drawings, wherein like reference characters are used throughout to designate like parts:

Figure 1:
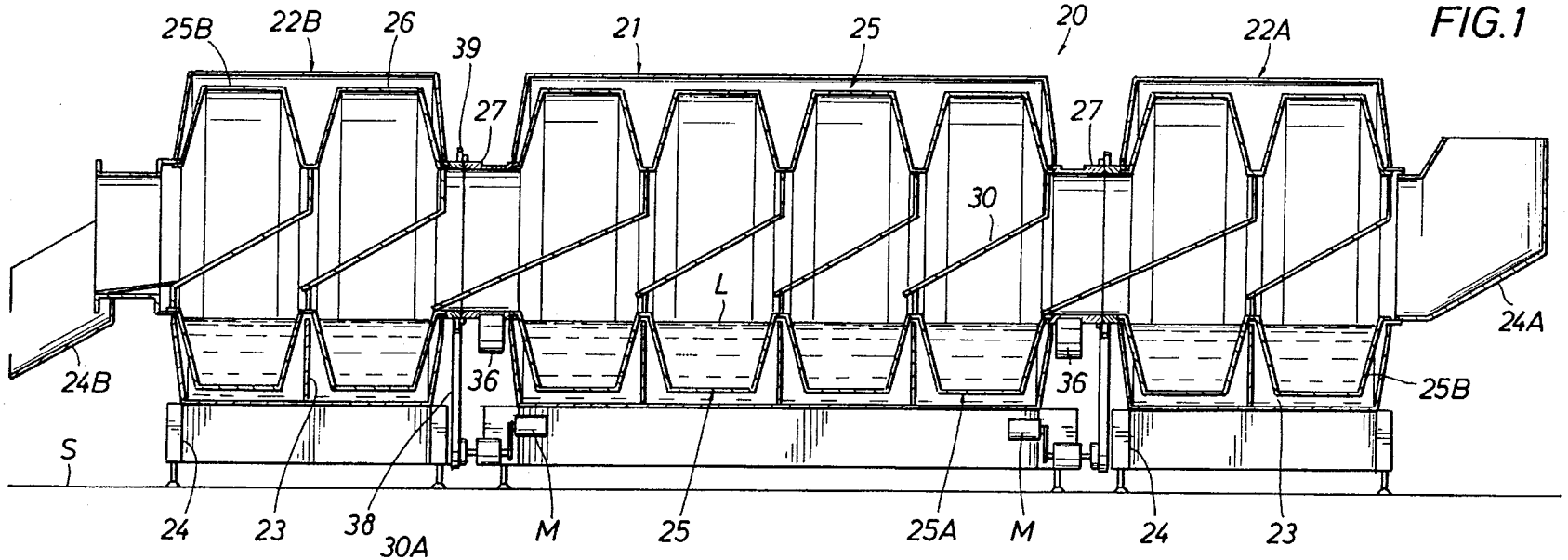
FIG. 1 is a longitudinal sectional view of a machine constructed in accordance with first described embodiment of the present invention, wherein the inlet is disposed on the right-hand end thereof and the outlet on the left-hand end thereof.
Figure 5:
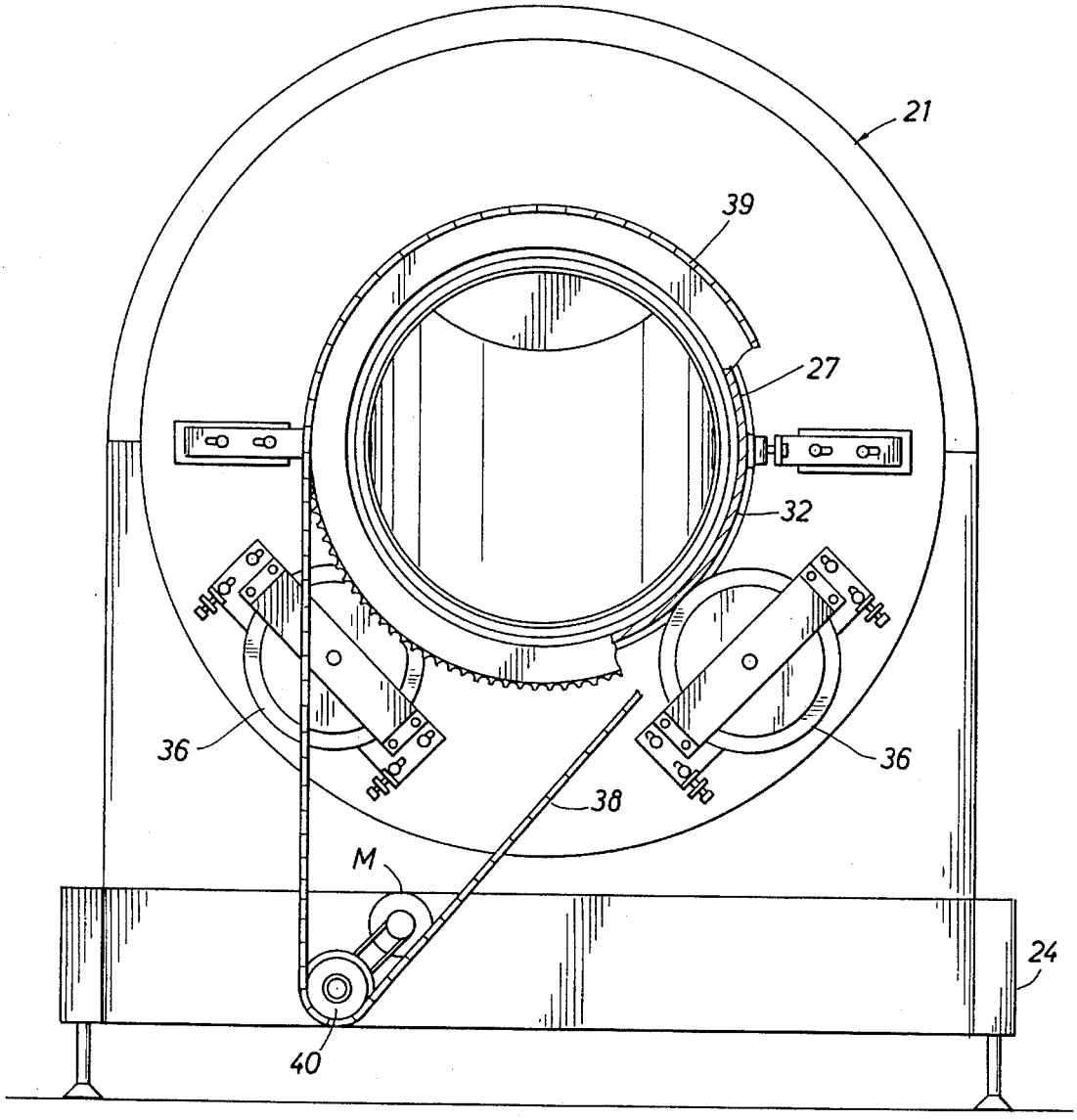
Figure 6:
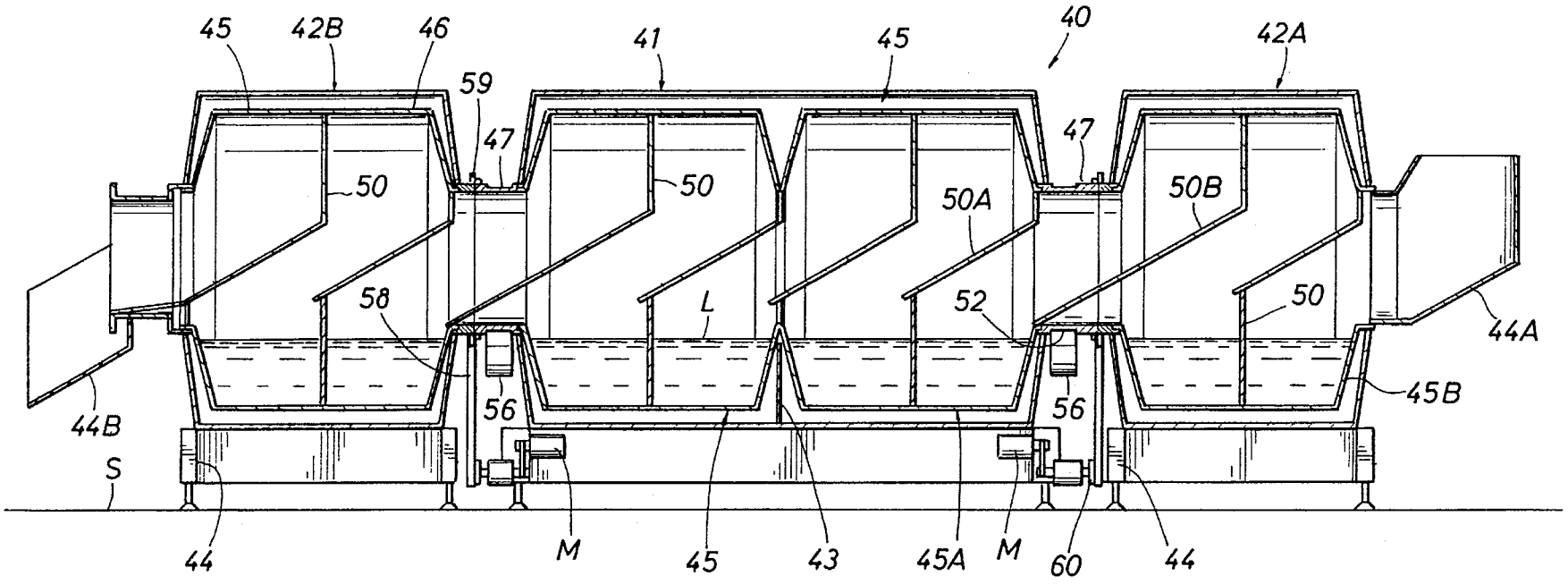

FIG. 5 is a cross-sectional view of the machine, as seen from the side of an end drum and showing the way in which the tubular member connecting adjacent drums of the intermediate and end sections of the inner housing is supported by rollers and driven by a chain; and FIG. 6 is a longitudinal sectional view similar to FIG. 1 of a machine constructed in accordance with the second described embodiment of the invention wherein each of the drums is of the tandem type.

With reference now to the details of the above described drawings, the machine embodiment of FIGS. 1 to 5, which is indicated in its entirety by reference character 20, is shown to comprise an intermediate outer housing 21, and a pair of additional outer housings 22A and 22B, one disposed on the upstream end of the intermediate housing and the other on the downstream end thereof. As shown, each housing comprises a generally cylindrical shell made up of upper and lower semicylindrical sections or portions which permit the upper section to be removed for access to the interior of the machine. Upright walls 23 in each housing divide it into bath sections, and, in the illustrated embodiment of the machine, there are three such walls in the intermediate housing dividing it into four bath sections, and one such wall in each of the additional outer housings dividing it into two bath sections.

Each of the housings is adapted to be supported above a base surface S, and at generally the same level by means of pedestals 24. As shown, each housing is supported by a pair of pedestals each disposed adjacent one end thereof. Each outer housing has an inlet on its right end and an outlet on its left end, with goods to be laundered being introduced into the upstream bath section in the upstream outer housing through a chute 24A, and being unloaded from the outlet in the downstream outer housing through a chute 24B.

The machine further comprises a continuous elongate inner housing 25 consisting of an intermediate section 25A of substantially cylindrically shaped drums 26 disposed in the intermediate outer housing 21 and outer sections 25B also made up of a plurality of substantially cylindrically shaped drums disposed in each of the additional outer housings 26A and 26B. As previously mentioned, each of the drums 26 is of the single module type having an inlet in one end and an outlet in the other end, with the inlets and outlets of adjacent drums in each inner housing section being welded to one another, and the outlet of the downstream drum of the upstream outer section and the intermediate section being connected to the inlet of the upstream drum of the adjacent section by means of a tubular member 27 extending through the end openings in the intermediate and additional outer housings.

Figure 3:
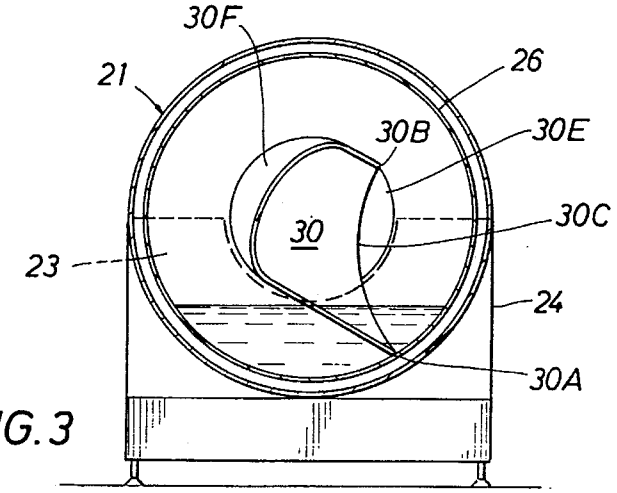
FIGS. 2 and 3 are cross-sectional views through the machine showing, in FIG. 2, the scoop in one of the drums positioned to transfer goods from that drum to an adjacent drum, while receiving goods from the other adjacent drum, and, in FIG. 3, the scoop rotated in a direction to pick up goods from the bottom of the drum preparatory to transferring them during a wash cycle.
Figure 2:
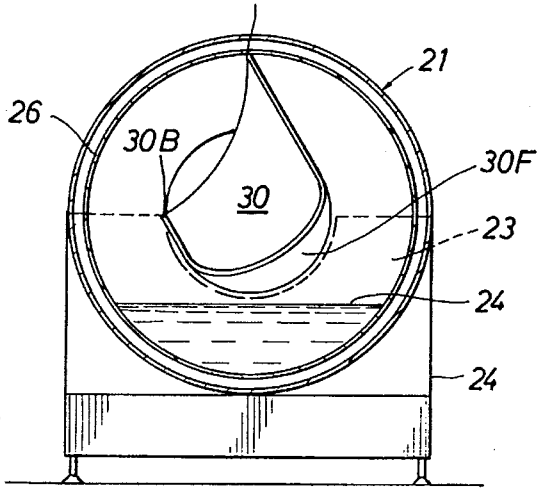

As shown in FIGS. 2 and 3, the walls 23 curve upwardly about the intersection of the outlet ends of the adjacent drums of each inner housing section. As well-known in the art, liquid fills the lower portions of each of the bath sections, and the outer walls of the drums are perforated so that, upon rotation of the inner housing, the goods are caused to move through the liquid in the bath sections for treating the goods in the desired manner.

As previously mentioned, and as will be described in more detail to follow, the inner housing is so supported as to locate the lower ends of each of the drums of its intermediate section within each of the bath sections of the intermediate outer housing, and those of its outer sections within a bath section in each of the additional outer housings.

As in the case of the machines of the previously described patents, a scoop 30 is mounted within each drum for extension between its end walls and is of such construction as to transfer goods from the drum to an adjacent downstream drum in response to rotation of the inner housing, as will be described to follow, following oscillation or rotation in the opposite direction to cause the goods contained in the lower portion of each drum to be impregnated with the liquid in the bath section.

As well-known in this art, the liquid contained in the bath sections may vary from one to the other lengthwise of the machine, depending on the stage of the wash cycle to be performed in those drums. Thus, for example, the liquid in the upstream drums may contain a prewash liquid, those downstream of the prewash drums may contain wash liquid, and subsequent downstream bath sections near the outlet of the machine may contain rinse liquid. In machines of this type, the liquids are ordinarily circulated from one bath section to another, often in counterflow relation to the direction of goods through the machine, by means of suitable plumbing external to the outer housings and including weirs which maintain a desired level L of the liquid in each bath section.

As shown in FIGS. 2 and 3, as well as in the aforementioned patents, the scoop in each drum comprises a curved sheet having one side edge 30A secured to the outer wall of the drum and another side edge 30B which is spaced from the outer wall. In the transfer position shown in FIG. 2, the scoop slants downwardly from the inlet end wall of the drum to the outlet end wall. More particularly, its upper end edge 30C is joined to the inlet end wall of the drum a short distance above the upper edge of the inlet, and its lower end edge 30D is joined to the outlet end wall a short distance beneath the lower periphery of the outlet. The portion of the inlet above edge 30C is closed by a wall 30E to prevent goods entering the drum from passing directly through it and into the scoop rather than into the drum below the scoop, and the outlet edge of the scoops of all drums except the downstream drums of each of the upstream end and intermediate sections of the inner housing are joined to a wall 30F at the outlet from that drum. On the other hand, the scoops of the downstream drums of each of the upstream end and intermdiate sections of the inner housings extend at a somewhat shallower angle through the tubular members and are joined to the inlets of adjacent drums.

During a wash cycle, the drum may be oscillated between alternate positions on opposite sides of its discharge or transfer portion shown in FIG. 2, or, alternatively, it may be rotated in a clockwise direction so as to permit the bath liquid to be circulated through the goods in the lower portion of the drum, but without transferring out of the drum. Upon completion of the wash cycle, the goods may be transferred out of the drum by rotation in a counterclockwise direction. Thus, as shown in FIG. 3, rotation of the drum in a counterclockwise direction permits the scoop to pick the goods up in the bottom portion of the drum and raise them from the position of FIG. 3 to the position of FIG. 2, at which time the goods will slide down the inclined portion of the scoop into the next downstream drum or out of the machine in the case of the endmost drum. The portion of the scoop which is lowermost during transfer may also be perforated, thereby minimizing the amount of liquid which is transferred out of the drum in the transfer position of the scoop.

Figure 4:
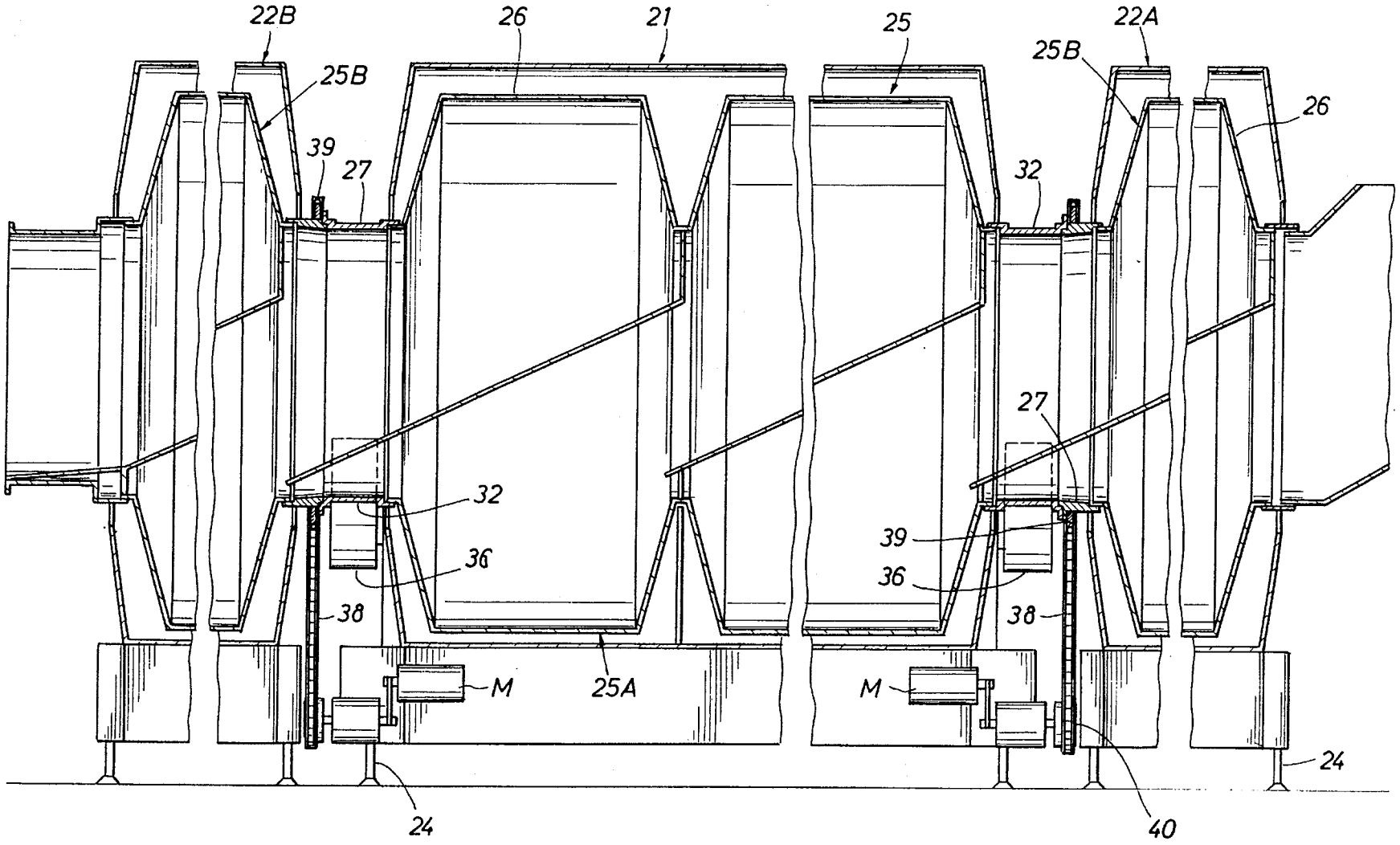
FIG. 4 is an enlarged longitudinal sectional view of the machine, broken away along its length.

As shown in FIGS. 4 and 5, each of the tubular members 27 connecting adjacent sections of the inner housing has a groove 32 formed about its outer diameter to receive rollers 36 supported on the adjacent outer wall of the intermediate outer housing. More particularly, as shown in FIG. 5, these rollers are mounted with their axes of rotation at positions beneath a horizontal diameter through the drum opening and thus in a position to support the inner housing for rotation, as previously described.

As also shown in FIGS. 4 and 5, a ring gear 39 is formed about the outer periphery of each tubular member on one side of the roller groove to receive a chain 38 for rotating the tubular member, and thus the inner housing, in the desired direction. Thus, the lower end of the chain extends about a sprocket 40 which in turn is driven by a motor M on the base surface S.

It will be obvious that the number and arrangement of the drums of each section of the inner housing, and thus the number and arrangement of the outer housings, may vary according to the circumstances, and those shown are merely by way of illustration. Also, of course, the inner housing may be made up of a combination of single and tandem drums.

The embodiment of the machine shown in FIG. 6, and indicated in its entirety by reference character 40, is similar to the machine 20 of FIGS. 1 to 5 in that it comprises an intermediate outer housing 41, and a pair of additional outer housings 42A and 42B, one disposed on the upstream end of the intermediate housing and the other on the downstream end thereof. Thus, as shown, each housing comprises a generally cylindrical shell made up of upper and lower semicylindrical sections or portions which permit the upper section to be removed for access to the interior of the machine. On the other hand, only the intermediate section is divided by an upright wall 43 into bath sections, each of the additional outer housing sections having only a single bath section.

As in the case of the machine 20, each of the housings is adapted to be supported above a base surface S, and at generally the same level by means of pedestals 44. As shown, each housing is supported by a pair of pedestals each disposed adjacent one end thereof. Each outer housing has an inlet on its right end and an outlet on its left end, with goods to be laundered being introduced into the upstream bath section in the upstream outer housing through a chute 44A, and being unloaded from the outlet in the downstream outer housing through a chute 44B.

The machine further comprises a continuous elongate inner housing 45 consisting of an intermediate section 45A having a pair of substantially cylindrically shaped drums 46 disposed in the intermediate outer housing 41 and outer sections 45B each made up of a single cylindrically shaped drum disposed in each of the additional outer housings 46A and 46B. As in the case of the machine 20, the outlet from the upstream outer section is connected to the inlet to the intermediate section and the outlet from the intermediate section is connected to the inlet to the downstream outer section by a tubular member 47 welded to them.

As shown, each such drum 46 is of the tandem type, in this case comprising a pair of end-to-end modules separated by a wall 50 intermediate the end walls of the drum modules, with a first scoop 50A welded to and extending between the inlet formed in the end wall and the outlet formed common wall, and a second scoop 50B welded to and extending between the inlet in the common wall and the outlet in either the end wall of the drum or, in the case of the downstream module of both the upstream and intermediate sections, through the tubular member 47, with the inlet formed in the end wall of the drum 50A of the next section. Thus, two batch goods are tumbled and then transferred from each drum simultaneously.

As in the machine 20, liquid L fills the lower portions of each of the bath sections, and the outer walls of the drums are perforated so that, upon rotation of the inner housing, the goods are caused to move through the liquid in the bath sections for treating the goods in the desired manner. Thus, as in the case of the previous machine, each scoop is of such construction as to cause the goods to be impregnated with the liquid in the bath section, upon oscillation or rotation in one direction, and transfer goods from the drum to an adjacent downstream drum or the next module of the same drum in response to rotation in the opposite direction. As will be described to follow, the inner housing is so supported as to locate the lower ends of each of the drums of its intermediate section within each of the bath sections of the intermediate outer housing, and the single drum of each of its outer sections within a bath section in each of the additional outer housings.

As in the prior described machine, the liquid contained in the bath sections may vary from one to the other lengthwise of the machine, depending on the stage of the wash cycle to be performed in those drums. Thus, for example, the liquid in the upstream section of the inner housing may contain a prewash liquid, the bath section in the intermediate section may contain wash liquid, and the downstream bath section may contain rinse liquid. As also previously noted, in machines of this type, the liquids are ordinarily circulated from one bath section to another, often in counterflow relation to the direction of goods through the machine, by means of suitable plumbing external to the outer housings and including weirs which maintain a desired level L of the liquid in each bath section.

As in the case of the prior machine, and as shown in connection therewith in FIGS. 4 and 5, each of the tubular members 47 connecting adjacent sections of the inner housing has a groove 52 formed about its outer diameter to receive rollers 56 supported on the adjacent outer wall of the intermediate outer housing. More particularly, as shown in FIG. 5, these rollers are mounted with their axes of rotation at positions beneath a horizontal diameter through the drum opening and thus in a position to support the inner housing for rotation, as previously described.

As also shown in FIGS. 4 and 5, a ring gear 59 is formed about the outer periphery of each tubular member on one side of the roller groove to receive a chain 58 for rotating the tubular member, and thus the inner housing, in the desired direction. Thus, the lower end of the chain extends about a sprocket 60 which in turn is driven by a motor M mounted on the base surface S.

It will be obvious that the number and arrangement of the drums of each section of the inner housing, and thus the number and arrangement of the outer housings, may vary according to the circumstances, and those shown are merely by way of illustration.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A continuous batch type washing machine of the top transfer type, comprising an intermediate outer housing, an upstream outer housing on one end of the intermediate outer housing, and a downstream outer housing on the other end of the intermediate outer housing, each outer housing having an inlet at one end, an outlet at the other end, the outlet of the upstream outer housing having a connection with the inlet of the intermediate outer housing and the outlet of the intermediate outer housing having a connection with the inlet of the downstream outer housing, and at least one bath section in the bottom portion of each outer housing, a continuous elongate inner housing comprising an intermediate section, an upstream section at one end of the intermediate section, and a downstream section at the other end of the intermediate section, each inner housing section including at least one generally cylindrically shaped drum having a perforated outer wall, an inlet in one end wall through which goods may enter the drum and an outlet in its other end wall through which goods may exit the drum, the inlet to a drum of the upstream section being aligned with the inlet to the upstream outer housing to provide an inlet to the machine and the outlet from a drum of the downstream section being aligned with the outlet of the downstream outer housing to provide an outlet from the machine, means external to the outer housings rotatably supporting the elongate inner housing at only the connections of a drum at one end of the intermediate section with an adjacent drum of the upstream section and a drum at the other end of the intermediate section with an adjacent drum of the downstream section so as to suspend the lower portion of each drum of the intermediate section in a bath section of the intermediate outer housing and the lower portion of each drum of the upstream and downstream sections in bath sections of the respective upstream and downstream outer housings, drive means external to the outer housings engaging each such connection for rotating the inner housing in opposite directional senses, each drum including at least one module having a scoop which is so constructed and arranged as to permit the circulation of liquid within the bath section through the goods in the module, while preventing transfer of the goods out of the module, in response to rotation of the inner housing in one directional sense or limited oscillation of the inner housing, but transfer goods out of the module into an adjacent drum or module of the same or an adjacent section of the inner housing, in response to rotation of the inner housing in the opposite directional sense.

2. As in claim 1, including means supporting each of the outer housing from a base surface.

3. As in claim 1, including means for supporting the opposite ends of each of the outer housings from a base surface.

4. As in claim 1, wherein at least one drum has only a single module.

5. As in claim 4, wherein each of the drums has only a single module.

6. As in claim 1, wherein at least one drum has end-to-end modules.

7. As in claim 6, wherein each of the drums has end-to-end modules.

8. A continuous batch type washing machine of the top transfer type, comprising an intermediate outer housing and an additional outer housing on each end of the intermediate outer housing, each outer housing having an inlet at one end, an outlet at the other end, the outlet of one of the additional outer housings having a connection with the inlet of the intermediate outer housing and the outlet of the intermediate outer housing having a connection with the inlet of the other additional outer housing, and at least one bath section in the bottom portion of each outer housing a continuous elongate inner housing including an intermediate section and an additional section on each end of the intermediate section, each inner housing section including at least one generally cylindrically shaped drum having a perforated outer wall, an inlet in one end wall through which goods may enter the drum and an outlet in its other end wall through which goods may exit the drum, the inlet to a drum of one of the additional sections being aligned with the inlet to one of the additional outer housings to provide an inlet to the machine and the outlet from a drum of the other additional section being aligned with the outlet of the other additional outer housing to provide an outlet from the machine, and means connecting the outlets and inlets of adjacent drums including a tubular member extending between and connecting a drum of each additional section with a drum at each end of the intermediate section, respectively, so as to provide a through opening between the sections, means external to the outer housings supporting only the tubular members so as to suspend the lower portion of each drum of the intermediate section in a bath section of the intermediate outer housing and the lower portion of each drum of each additional section in a bath section of an additional outer housing, drive means external to the outer housings engaging each such tubular member for rotating the inner housing in opposite directional senses, each drum including at least one module having a scoop which is so constructed and arranged as to permit the circulation of liquid within the bath section through the goods in the module, while preventing transfer of the goods out of the module, in response to rotation of the inner housing in one directional sense or limited oscillation of the inner housing,but transfer goods out of the module into an adjacent drum or module of the same or an adjacent section of the inner housing, in response to rotation of the inner housing in the opposite directional sense.

9. As in claim 8, including means supporting each of the outer housings from a base surface.

10. As in claim 8, including means for supporting the opposite ends of each of the outer housings from a base surface.

11. As in claim 8, wherein at least one drum has only a single module.

12. As in claim 11, wherein each of the drums has only a single module.

13. As in claim 8, wherein at least one drum has end-to-end modules.

14. As in claim 13, wherein each of the drums has end-to-end modules.

* * * * *